US007896300B2

(12) United States Patent
LaRossa

(10) Patent No.: US 7,896,300 B2
(45) Date of Patent: Mar. 1, 2011

(54) SUPPORTING MOUNT REMOVABLY FIXABLE TO A GENERALLY VERTICAL COLUMNAR STRUCTURE

(76) Inventor: Donato LaRossa, Malvern, PA (US)

( * ) Notice: Subject to any disclaimer, the term of this patent is extended or adjusted under 35 U.S.C. 154(b) by 0 days.

(21) Appl. No.: 12/277,437

(22) Filed: Nov. 25, 2008

(65) Prior Publication Data

US 2009/0072104 A1 Mar. 19, 2009

Related U.S. Application Data

(63) Continuation-in-part of application No. 11/834,269, filed on Aug. 6, 2007.

(51) Int. Cl.
*A47B 96/06* (2006.01)

(52) U.S. Cl. ..... 248/218.4; 248/295.11; 248/235; 248/241; 248/219.1; 248/291.2; 248/242; 248/245; 248/250

(58) Field of Classification Search ..... 248/218.4, 248/295.11, 235, 241, 219.1, 219.2, 242, 248/245, 250

See application file for complete search history.

(56) References Cited

U.S. PATENT DOCUMENTS

| | | | | | |
|---|---|---|---|---|---|
| 890,804 | A * | 6/1908 | Shears | 248/246 |
| 3,746,294 | A * | 7/1973 | Johnston | 248/219.4 |
| 4,659,044 | A * | 4/1987 | Armstrong | 248/218.4 |
| 5,118,060 | A * | 6/1992 | Spronken | 248/218.4 |
| 5,470,054 | A * | 11/1995 | Bohrman | 473/481 |
| 5,570,880 | A * | 11/1996 | Nordgran | 473/481 |
| 5,842,581 | A * | 12/1998 | Graefe | 211/17 |
| 6,017,009 | A * | 1/2000 | Swartz et al. | 248/245 |
| 6,273,381 | B1 * | 8/2001 | Riblet | 248/248 |
| 6,367,751 | B1 * | 4/2002 | Perrott | 248/218.4 |
| 6,722,620 | B2 * | 4/2004 | Rieger | 248/242 |
| 7,152,835 | B1 * | 12/2006 | Riblet | 248/246 |
| 7,185,803 | B1 * | 3/2007 | Lutzke | 232/39 |
| 7,267,310 | B2 * | 9/2007 | Welch et al. | 248/218.4 |
| 2006/0226313 | A1 * | 10/2006 | Welch et al. | 248/218.4 |
| 2007/0045491 | A1 * | 3/2007 | Spencer et al. | 248/218.4 |
| 2009/0152419 | A1 * | 6/2009 | Wallace | 248/219.4 |

OTHER PUBLICATIONS

Whatever works website, "Set of 2 Spoutie Downspout Hangers", downloaded Aug. 6, 2007 from http://www.whateverworks.com, in color and also grayscale.

* cited by examiner

*Primary Examiner*—Anita M King
*Assistant Examiner*—Nkeisha J Smith
(74) *Attorney, Agent, or Firm*—Law Offices of Steven H. Meyer, LLC

(57) ABSTRACT

A supporting mount mounts a device to a post and is removably fixed to the post without being fastened thereto by any penetrating fastener. A front panel is at the front post face and has the device fixed thereto. A pair of opposing side panels are at respective side post faces. Each side panel has a lower lateral edge connecting to the front panel, an upper lateral portion distal from the front panel, and a hook at about the upper lateral portion. A connecting element at the back post face engages the hooks at the upper lateral portions of the side panels. The mount pivots into frictional contact with the back post face at the top portion of the connecting element and with the front post face at a bottom portion of the front panel.

18 Claims, 4 Drawing Sheets

SUPPORTING MOUNT REMOVABLY FIXABLE TO A GENERALLY VERTICAL COLUMNAR STRUCTURE

CROSS-REFERENCE TO RELATED APPLICATION

The present application is a continuation-in-part of a U.S. patent application Ser. No. 11/834,269, filed on Aug. 6, 2007, and entitled "Supporting Mount Removably Fixable to a Generally Vertical Columnar Structure", hereby incorporated by reference in its entirety.

TECHNICAL FIELD

The present application is directed to a supporting mount that is employed to attach a device to a generally vertical columnar structure such as a vertical post, where the mount is removably fixable to the post or the like. More particularly, the present invention is directed to such a mount that is fixed to the post or other structure without the use of any screws or other fasteners that would be required to penetrate the post or other structure. Accordingly, the post or other structure is not marred by the supporting mount, at least by the use of such fasteners, and the supporting mount can be fixed to and removed from the post or other structure with relative ease.

BACKGROUND OF THE INVENTION

In the setting of a home or a commercial facility such as an office building or hotel, for example, and particularly in the exterior of such a setting, it may be the case that a person may wish to put up or otherwise erect a device that is intended to be displayed from or mounted to a generally vertical surface. Such a device can for example be a flag hanging from a flag staff or a bird feeder hanging from an ornamental hook, among other things. While one such vertical surface from which the device can be displayed or mounted may be the side of an exterior wall, it is to be appreciated that in at least some circumstances such an exterior wall is not available, or is considered to be disadvantageous or inadvisable for whatever reason.

In such a case, then, or as an alternative, it may be that another vertical surface from which the device can be displayed or mounted is a generally vertical columnar structure such as a wood post. As may be understood, such a post may be found in many exterior settings, either mounted alone or as part of another structure. For example, in the case of a home, it may be that such home has an exterior deck or patio or the like that includes a railing, and the railing is constructed to include such posts. Similarly, in the case of a park, it may be that such park has a nature trail with a fence, and the fence is constructed to include such posts.

Typically, the device is displayed from or mounted to the post by way of a bracket or the like that is designed to hold the device and that is also designed to be securely affixed to the post. For example, a flag hanging from a flag staff may be displayed from such a post by way of a bracket that is designed to receive the flag staff and that is affixed to the post by way of a number of screws or the like that penetrate and extend into the post. Similarly, a bird feeder hanging from an ornamental hook may be mounted to such a post by way of the ornamental hook that is also affixed to the post by way of a number of screws or the like that penetrate and extend into the post.

However, it may be that penetrating into the post with screws or the like is undesirable. For example, such penetration into a wood or a metal post allows water to access the interior of such post, thus hastening the post to rot if wood or to rust if iron or steel. Most notably, though it is oftentimes now the case that the post if wood is covered with a vinyl or PVC (Polyvinyl Chloride) sheathing, and thus penetrating into the post of necessity includes penetrating through the covering. Such penetration of the covering is not particularly egregious if the device is being permanently installed to the post. However, if the device is being installed to the post on a temporary basis only, such penetration of the covering results in the covering being marred with apertures that are likely on prominent display once the device is removed from the post. Moreover, and regardless of whether the device is installed to the post on a temporary or a permanent basis, such penetration of the covering allows water to access the interior of such post and cause rot or rust or the like.

Accordingly, a need exists for a supporting mount that is employed to attach a device to a generally vertical columnar structure such as a vertical post, where the mount is removably fixable to the post or the like. More particularly, a need exists for such a mount that is fixed to the post without the use of any screws or other fasteners that would be required to penetrate the post or any covering on the post. Accordingly, the post is not marred by the supporting mount, at least by the use of such fasteners, and the supporting mount can be fixed to and removed from the post or other structure with relative ease.

SUMMARY OF THE INVENTION

The aforementioned needs are satisfied at least in part by the present invention in which a supporting mount is provided to mount a device to a generally vertical post having front and back faces and a pair of opposing side faces extending between the front and back faces. The mount is removably fixed to the post without being fastened to the post by any fastener that would penetrate into the post.

A front panel is positioned at the front face of the post, has a pair of opposing lateral edges, and has the device fixed thereto. A pair of opposing side panels are positioned at respective side faces of the post. Each side panel has a lower lateral edge that faces toward and connects to a respective lateral edge of the front panel and an upper lateral portion distal from the front panel. The lower lateral edge on each side panel is vertically positioned with respect to the post to be relatively lower and the upper lateral portion on each side panel is vertically positioned with respect to the post to be relatively higher. Each side panel has a hook thereon at about the upper lateral portion thereof. The side panels are bilaterally arranged to mirror each other with respect to the post.

A connecting element generally horizontally positioned at the back face of the post interconnects the side panels at about the upper lateral portions thereof by being retainingly engaged by the hooks thereat. The front panel, side panels, and connecting element surround the post. The device as fixed to the mount causes same to pivot into a frictional contact with the back face of the post at the connecting element and with the front face at a portion of the front panel vertically lower than the connecting element. The frictional contact of the mount at the front and back faces of the post resists gravity and prevents the mount with the device from sliding down the post even though the mount is not fastened to the post by any fastener that would penetrate into the post.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE INVENTION

Typical Environment

The supporting mount of the present invention may be employed in any appropriate setting or environment, although as noted above the supporting mount is particularly useful in an environment where a person wishes to put up or otherwise erect or install a device that is intended to be displayed from or mounted to a generally vertical surface. Such a device may be any appropriate device without departing from the spirit and scope of the present invention. For example, the device may be a flag hanging from a flag staff or a bird feeder hanging from an ornamental hook, as was noted above, or could be a candle or lamp, a shelf, a fan, a shade, or an umbrella, among other things, each with an appropriate attaching device.

Figure 1:
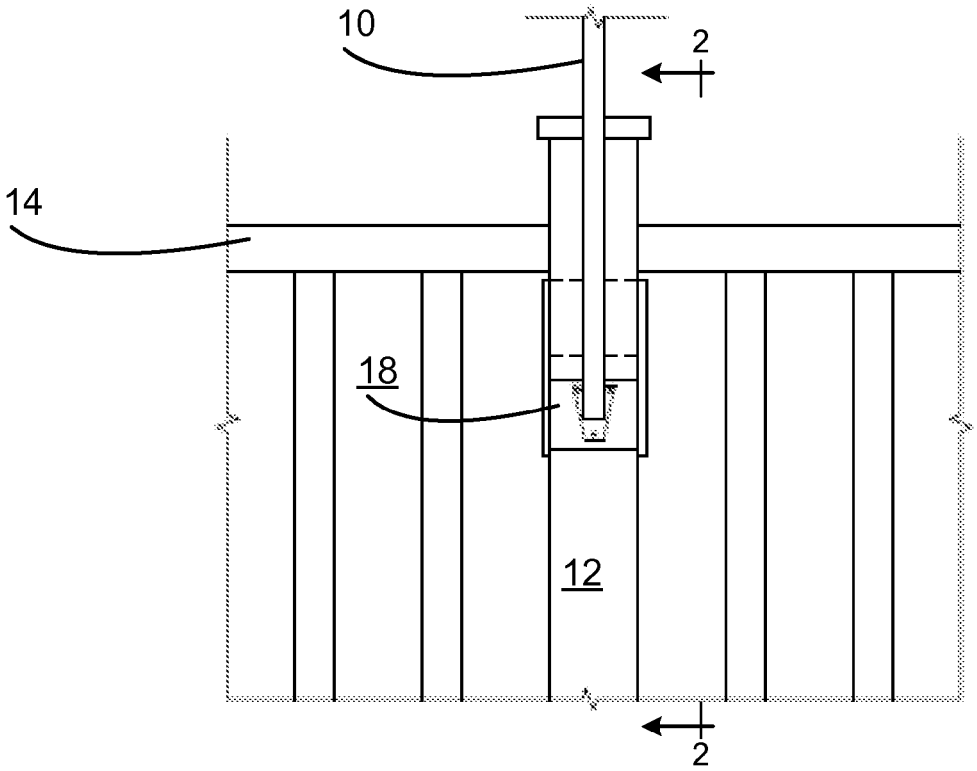
FIG. 1 is a plan view of a railing such as may be employed on a deck or patio, where the railing includes a generally vertical columnar structure such as a post, and where a supporting mount is removably fixed to the post and is employed to attach a device to the post in accordance with one embodiment of the present invention.
Figure 2:
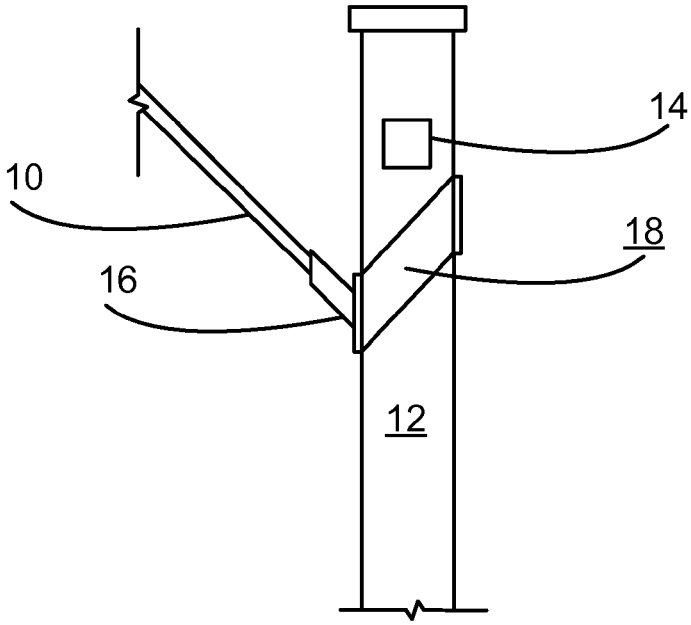
FIG. 2 is a cut-away side view of the post and supporting mount taken along line 2-2 of FIG. 1.

In one particular environment, and turning now to FIGS. 1 and 2, the device 10 is mounted to a post 12, where the post 12 is part of and/or supports a railing 14, such as for example a railing 14 of an exterior deck or patio of a home. Of course, the post 12 may also appear at any other appropriate setting without departing from the spirit and scope of the present invention. For example, the post 12 may be part of a fence in a park or at a beach, or may be the support for a structure such as a building, or may be employed to elevate an element such as a bird feeder or a weather data gathering device such as an anemometer or a wind sock. As should be understood from the drawings, the post 12 is generally expected to be a square or rectangular post in horizontal cross-section, such as a 4 by 4, 4 by 6, or 6 by 6 post, although round or oval posts 12 and posts of other sizes may also be employed without departing from the spirit and scope of the present invention.

Typically, and as best seen in FIG. 2, the device 10 includes a mounting bracket 16 by which the device 10 can be installed to a generally vertical surface such as the post 12. For example, in the case of the device 10 being a flag hanging from a flag staff such as is shown in FIG. 2, the corresponding bracket 16 is a receiver that receives the distal end of the flag staff and that is affixed to the a vertical surface by way of a number of screws or the like (not shown). Similarly, in the case of a device 10 being a bird feeder or the like hanging from an ornamental hook (not shown), the ornamental hook may itself be affixed to the vertical surface by way of a number of screws or the like (not shown).

However, and as was set forth above, penetrating into the post 12 with screws or the like may be undesirable. For one thing, such penetration into a wood or a metal post 12 allows water to access the interior of such post 12, thus hastening the post 12 to rot if wood or to rust if iron or steel. For another thing, if the post 12 is covered with a decorative covering or with a covering such as vinyl or PVC (Polyvinyl Chloride) sheathing, penetrating into the post 12 of necessity includes penetrating through the covering. Particularly when the device 10 and associated mounting bracket 16 are removed, then, the apertures in the covering that result from the penetration therethrough are on display and tend to mar the appearance of the post 12.

Note here that FIGS. 1 and 2 and the previous discussion in connection therewith are intended to provide a brief general description of a typical environment in which the present invention may be implemented. It should be understood, however, that the present invention may also be implemented in other similar environments without departing from the spirit and scope of the present invention.

Supporting Mount

In one embodiment of the present invention, to mount the device 10 to the post 12, a supporting mount 18 such as that shown in FIGS. 1-4 is employed. As may be appreciated, with such supporting mount 18, the device 10 is not attached to the post 12 but is instead attached by way of a corresponding mounting bracket 16 or the like to the mount 18, and the mount 18 is removably fixed to the post 12. Note, though that the use of such a mounting bracket is not a requirement of the present invention. Significantly, and as will be set forth in more detail below, the mount 18 is removably fixed to the post 12 in such a manner as to avoid marring the appearance of the post 12 by way of penetrating fasteners or the like.

Figure 3:
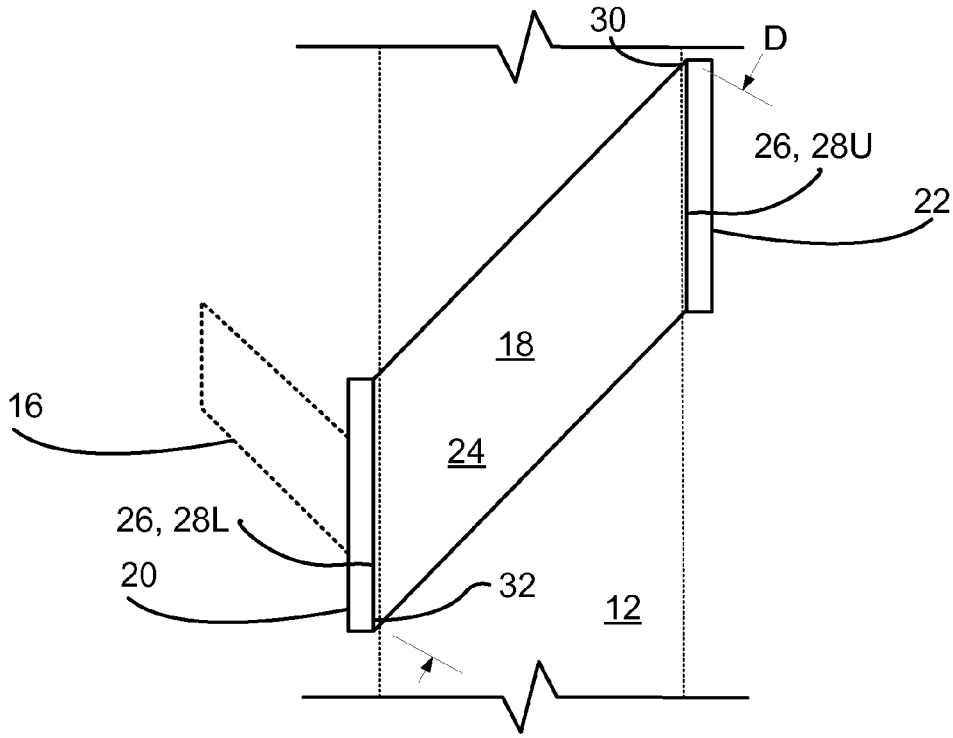
FIG. 3 is a close-up view of the supporting mount as shown in FIG. 2.
Figure 4:
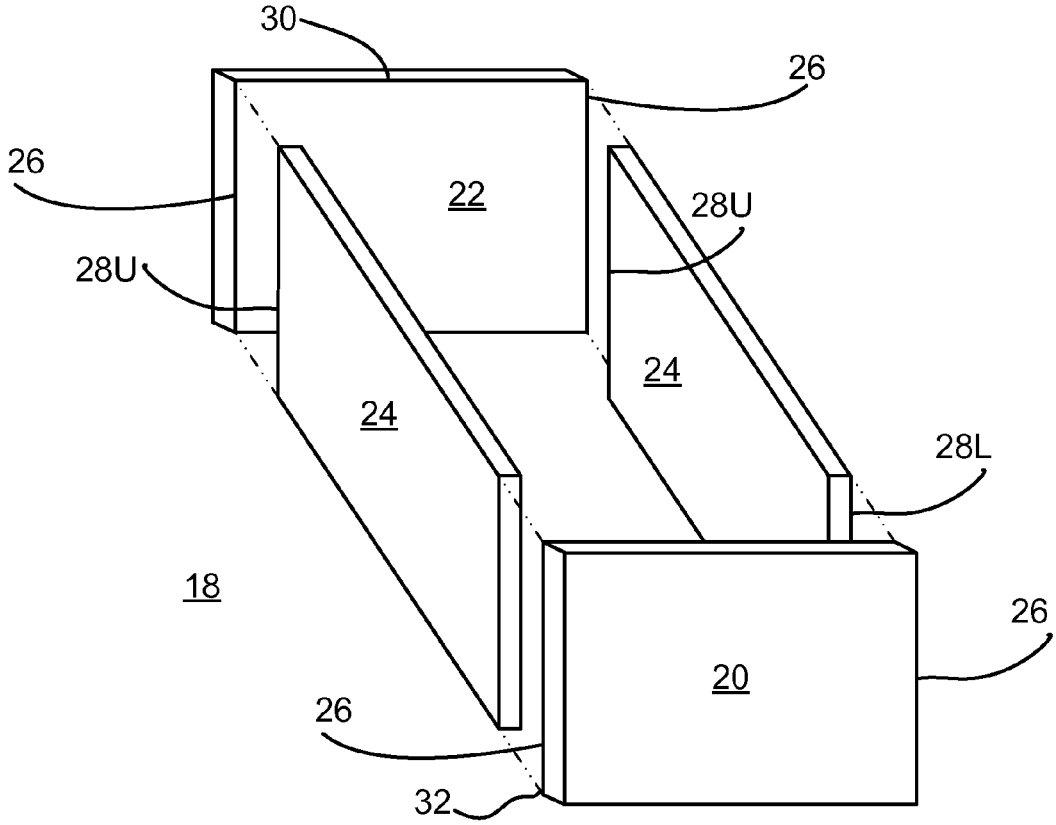
FIG. 4 is an exploded perspective view of the supporting mount of FIGS. 1-3.

As best seen in FIGS. 3 and 4, and in one embodiment of the present invention, the supporting mount 18 is constructed to include a front panel 20, a back panel 22, and a pair of opposing side panels 24. Generally, and as shown, the panels 20, 22, 24 are joined to surround the post 12, as is shown in FIG. 3. Presumably, the supporting mount 18 must be formed around the post 12 and cannot be passed over the top of such post 12, especially if the post 12 is capped on top or is especially tall. As may be appreciated, the panels 20, 22, 24 are dimensioned so as to accommodate the post 12 within the supporting mount, although as will be set forth in more detail below the post 12 is not intended to be gripped by the supporting mount 18 in the manner of an interference fit, especially inasmuch as such an interference fit may tend to mar the appearance of the post 12, and at any rate may cause excessive difficulty when fixing the mount 18 to the post 12.

Notably, and as seen in FIGS. 3 and 4, each of the front and back panels 20, 22 is generally rectangular and has a pair of opposing lateral or side edges 26, and each of the side panels 24 is generally trapezoidal and has a lower lateral edge 28L that faces toward the front panel 20 and an upper lateral edge 28U that faces toward the back panel 22. As joined to form the supporting mount 18, then, each lateral edge 26 of the front panel 20 is attached to a respective lower lateral edge 28L of the opposing side panels 24, and each lateral edge 26 of the back panel 22 is attached to a respective upper lateral edge 28U of the opposing side panels 24. As a result, and as seen, the side panels 24 of the supporting mount 18 are bilaterally arranged to mirror each other with respect to the post 12, and the front panel 20 is vertically arranged with respect to the post 12 to be significantly lower on the post 12 as compared with the back panel 22.

As shown in FIG. 3 (but removed for purposes of clarity in FIG. 4), the mounting bracket 16 or the like of the device 10 is attached to the front panel 20 of the supporting mount 18. Accordingly, when the supporting mount 18 is fixed to the post 12, and presuming that the supporting mount 18 is only loosely fitted to the post 12, the weight of the mounting bracket 16 or the like and of the device 10 is applied to the supporting mount 18 as a force that effectively causes the supporting mount 18 to pivot into contact with the post 12. As may be appreciated, such pivoting in particular causes the top portion 30 of the back panel 22 and the bottom portion 32 of the front panel 20 to contact the post 12 at respective faces thereof. As may be appreciated, such contact at both locations is a frictional contact with a pressure that is applied more directly to the surface of the post 12 as the distance D (FIG. 3) between the aforementioned top portion 30 of the back panel 22 and bottom portion 32 of the front panel 20 increases. Accordingly, the generally trapezoidal shape of each of the side panels 24 is employed to effectively increase the distance D, thereby more directly applying the contact pressure and the frictional force imparted thereby.

Crucially, such increased frictional force resists gravity and prevents the supporting mount 18 from sliding down the post 12, even though the supporting mount 18 is not secured to the post 12 by any penetrating screws or the like. Note here that the supporting mount 18 does not slide down the post 12 only if the frictional contact is significant enough. If such frictional contact is not significant enough, a friction-enhancing material such as padding or a textured surface maybe added at the points of contact that would tend to increase such frictional contact. Such material may of course be any appropriate material at any appropriate location without departing from the spirit and scope of the present invention. For example, such material may be mounted at the inside of the top portion 30 of the back panel 22 and/or of the bottom portion 30 of the front panel 20, and may be felt, fabric, or a rubber or polymeric or elastomeric material, among other things.

As was set forth above, the distance D between the top portion 30 of the back panel 22 and the bottom portion 32 of the front panel 20 is increased by the generally trapezoidal shape of each of the side panels 24. As seen in the drawings, such trapezoidal shape effectively vertically positions the front and back panels 20, 22 with respect to the post 12 so that the top edge of the front panel 20 is below the bottom edge of the back panel 22. However, it may be appreciated that other vertical positions of the front and back panels 20, 22 and the respective bottom portion 32 and top portion 30 thereof may be employed without departing from the spirit and scope of the present invention, as long as a sufficient distance D is maintained.

Note that the mechanisms employed to attach the panels 20, 22, 24 to each other may be any appropriate mechanisms without departing from the spirit and scope of the present invention. For one example, at least some or all of the panels 20, 22, 24 may be glued or epoxied together, or may be fused together by sonic or other heat welding if appropriate, or may be formed as a single unit, such as by an injection molding process, in which case such panels would be formed from a plastic or polymeric or elastomeric material.

For another example, appropriately sized screws may be employed to join some or all of the panels 20, 22, 24 to each other in a manner that should be evident to the relevant public and that therefore need not be set forth herein in any detail. Of course, such screws should not be employed to penetrate into the post 12 for the reasons set forth above, but instead each screw should pass through one of the panels 20, 22, 24, and penetrate into another of the panels 20, 22, 24 as appropriate.

Note that permanently or semi-permanently attaching all of the panels 20, 22, 24 to each other, such as for example by screws or by heat welding or gluing, may not be desirable, especially if the supporting mount 18 is to be fixed to and removed from a post 12 on a fairly regular basis. As should be appreciated, in such a case, and presuming that the supporting mount 18 must be formed around the post 12 and cannot be passed over the top of such post 12, at least one of the panels 20, 22, 24 must be removed from the supporting mount 18 to remove same from the post 12, and likewise such panel 20, 22, 24 must be inserted into the supporting mount 18 to fix same to the post 12, and permanent or semi-permanent attachment of all of the panels 20, 22, 24 would prevent such removal and insertion, or at least render same to be difficult.

Accordingly, in one embodiment of the present invention, one of the panels 20, 22, 24, is joined to the others by way of a mechanism that can be attached and detached with relative ease, while the remaining panels 20, 22, 24 are joined to each other by more permanent fasteners such as the aforementioned screws, glue, welding, or the like. For example, in one embodiment of the present invention, one of the panels 20, 22, 24 is joined to the others by way of a hinge or the like at one lateral edge thereof that is also attached to the lateral edge of the adjacent panel 20, 22, 24, and by way of a corresponding latch at the other lateral edge thereof that interacts with a catch at the lateral edge of the adjacent panel 20, 22, 24. Thus, in such a case it may be that the back panel 20 is joined to the others by way of a hinge or the like at a first lateral edge 26 thereof that is also attached to the upper lateral edge 28U of the corresponding side panel 24, and by way of a corresponding latch at a second lateral edge 26 thereof that interacts with a catch at the upper lateral edge 28U of the corresponding side panel 24. Of course, other arrangements may also be employed without departing from the spirit and scope of the present invention.

Figure 5:
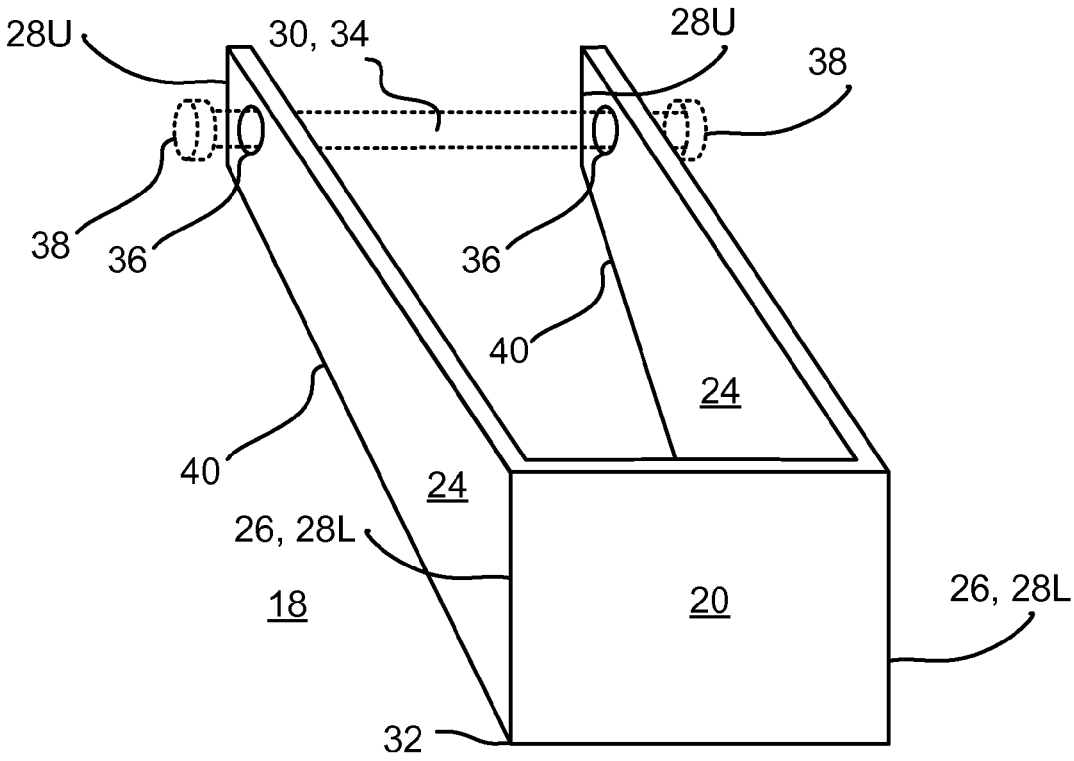
FIG. 5 is a perspective view akin to that of FIG. 4 although not exploded and shows a supporting mount in an alternate embodiment of the present invention.

Bearing in mind that only the top portion 30 of the back panel 22 actually contributes to the frictional contact of such back panel 22 with the post 12, and that the remainder of the back panel 22 is not believed to be of any significant material purpose, and in an alternate embodiment of the present invention, the bulk of the back panel 22 is dispensed with, as is seen in FIG. 5, and instead a cross-connector 34 is employed adjacent the upper lateral edges 28U of the side panels 24 to interconnect the side panels 24 in the area of what was the top portion 30 of the back panel 22. As may be appreciated, in such an embodiment the cross-connector 34 not only functions as the top portion 30 of the back panel but also can be removed and replaced to fix the supporting mount 18 to and remove the supporting mount 18 from the post 12.

With such a cross-connector 34, and as should be appreciated, the mounting bracket 16 may be mounted to the post 12 by removing the cross-connector 34 to create an opening by which the interior space surrounded by the mounting bracket 16 may be accessed. Thereafter, the mounting bracket 16 without the cross-connector 34 may be generally horizontally moved such that the generally vertical post 12 passes through the opening and into the interior space, after which the cross-connector 34 can be attached to the mounting bracket 16 to close the opening.

Note that the cross-connector 34 may be formed in any appropriate manner from any appropriate material and may be connected to the reminder of the supporting mount 18 in any appropriate manner without departing from the spirit and scope of the present invention. For example, the cross-connector 34 may be a generally cylindrical length of material, such as a rod, a dowel constructed from wood or another appropriate material, or a piece of tubing in the manner of a relatively small diameter of PVC tubing or the like, perhaps about ⅜ or ½ inch interior diameter and ⅞ or 1 inch external diameter. Such a rod, dowel, or tubing may be slid through apertures 36 (FIG. 5) in the side panels 24 adjacent the upper lateral edges 28U thereof to interconnect the side panels 24 in the area of what was the top portion 30 of the back panel 22, as is shown in FIG. 5. In addition, and as shown, caps 38 may be positioned at the external sides of the side panels 24 and over either end of the cross-connector 34 in situ in order to assist in holding the cross-connector 34 in place, with at least one of the caps 38 being removable and replaceable.

Note, too, that with such a cross-connector 34, and as shown in FIG. 5, the side panels 24 need not necessarily be generally trapezoidally shaped. Instead, and as seen, each side panel 24 can have a bottom edge 40 that extends generally from the bottom of the lower lateral edge 28L to the bottom of a reduced upper lateral edge 28U in the region of the cross-connector 34 and at what was the top portion 30 of the back panel 24. Of course, the upper lateral edge 28U of each side panel 24 should extend back somewhat further in the region of the cross-connector 34 so as to provide enough material to define the apertures 36. Although not shown in FIG. 5, the side panels 24 can be decoratively shaped with curves and the like to be more aesthetically pleasing. Notably, the upper lateral edges 28U of each side panel 24 may be rounded to remove at least some of the sharper edges and/or junctions that could otherwise be considered to be a safety hazard.

Regardless of whether the side panels 24 are trapezoidally shaped or otherwise, and in any embodiment of the present invention, the top edge of the front panel 20 is below the contacting top portion 30 of the back panel 22/cross-connector 34 so that a sufficient distance D is maintained between such top portion 30 and the bottom portion 32 of the front panel 20. Empirically, it has been determined that the contacting top portion 30 of the back panel 22/cross-connector 34 should be at least about 45 degrees from horizontal with respect to the top edge of the front panel 20. However, it may be appreciated that other angular positions of the top portion 30 and top edge may be employed without departing from the spirit and scope of the present invention.

Figure 6:
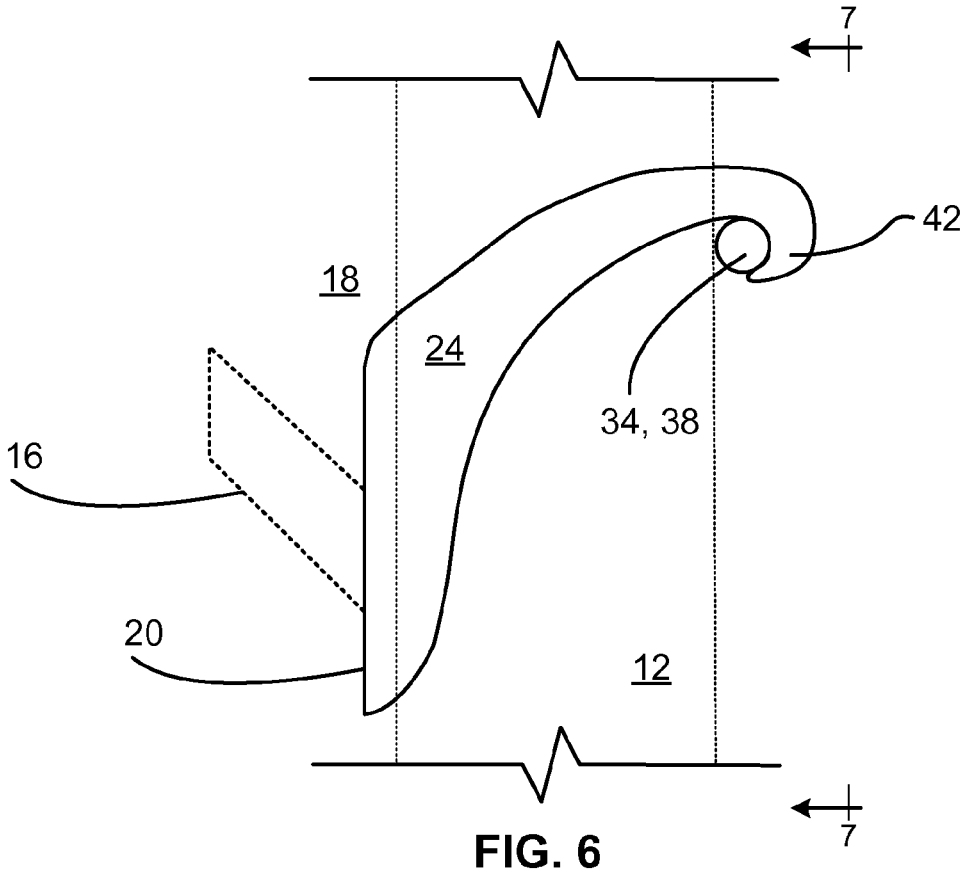
FIG. 6 is a side view akin to that of FIG. 3 and shows a supporting mount in another alternate embodiment of the present invention.
Figure 7:
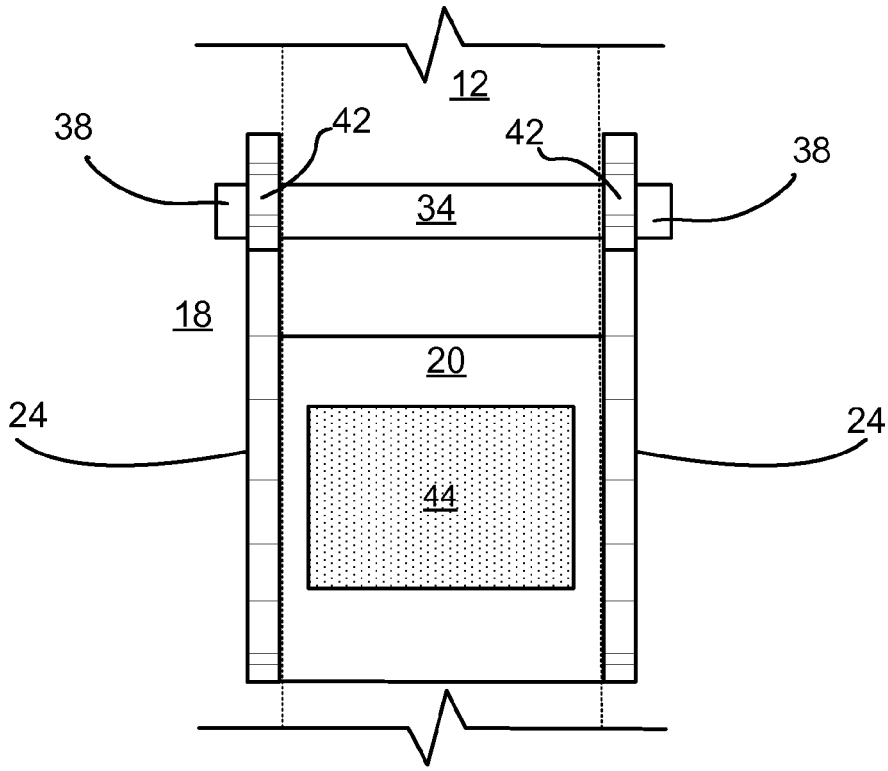
FIG. 7 is a rear view of the supporting mount taken along the line 7-7 of FIG. 6 in the another alternate embodiment of the present invention.

In another embodiment of the present invention, and turning now to FIGS. 6 and 7, the bulk of the back panel 22 is again dispensed with and a cross-connector 34 is again employed adjacent the upper lateral edges (areas) 28U of the side panels 24 to interconnect the side panels 24 in the area of what was the top portion 30 of the back panel 22. Here again, the cross-connector 34 not only functions as the top portion 30 of the back panel but also can be removed and replaced to fix the supporting mount 18 to and remove the supporting mount 18 from the post 12 in the manner that was generally set forth above in connection with FIG. 5.

Note though that in the embodiment shown in FIGS. 6 and 7, the cross-connector 34 is not slid through apertures 36 (FIG. 5) in the side panels 24 to interconnect the side panels 24. Instead, and as best seen in FIG. 6, the side panels 24 are formed to include hooks 42 at about the upper lateral areas 28U (FIG. 3) thereof, and the cross-connector 34 is brought into retaining engagement with the hooks 42 to interconnect the side panels 24 in the area of what was the top portion 30 of the back panel 22 (FIG. 3). As shown, each hook 42 is generally co-planar with the side panel 24 thereof and has an opening that faces generally downwardly, although other arrangements may also be employed. Each hook 42 may achieve retaining engagement with the cross-connector 34 by way of an interference fit, or by way of a looser fit if the engagement of the hook 42 with the cross-connector 34 in combination with the engagement of the overall supporting mount 18 with the post 12 tends to hold the cross-connector 34 in place with respect to the hook 42.

Such retaining engagement may be more particularly achieved by way of moving the cross-connector 34 generally horizontally into serial contact with each hook 42, or by way of moving the cross-connector 34 generally vertically and upwardly (as shown in FIG. 6) or downwardly (not shown) into generally simultaneous contact with each hook 42, as should be appreciated. As before, and as best seen in FIG. 7, caps 38 may be positioned at the external sides of the side panels 24 and over either end of the cross-connector 34 in situ in order to assist in holding the cross-connector 34 in place, with at least one of the caps 38 being removable and replaceable if the aforementioned horizontal engagement is anticipated.

As before, with such a cross-connector 34, the side panels 24 of the another embodiment need not necessarily be generally trapezoidally shaped. Instead, and as best seen in FIG. 6, each such side panel 24 can have a generally curving form that may be shaped to have a pleasing appearance. Notably, each side panel 24 may be formed to have a respective hook 42 generally integral therewith generally adjacent where contact with the cross-connector 34 is to be expected, as is best seen in FIG. 6, in which case the integral hook 42 may be part of the generally curving form and also shaped to have a pleasing appearance. Of course, the hook 42 may alternately be separate and distinct from each side panel 24 and appropriately coupled thereto. In either case, each hook 42 should extend back somewhat further in the region of the cross-connector 34 so as to allow the cross-connector 34 to engage such hook 42.

As shown in FIG. 7, various embodiments of the supporting mount 18 may be provided with the aforementioned friction-enhancing material at points of contact if frictional contact thereat is not found to be significant enough. As seen in FIG. 7, the friction-enhancing material is a friction panel 44 with a relatively high-friction surface that engages the post 12, where the friction panel 44 is securely mounted on the internal surface of the front panel 20 of the supporting mount 18. As also seen, the friction panel 44 need not necessarily be at the bottom portion 32 of the front panel 20. In particular, if the friction panel 44 provides sufficient frictional contact at a location other than such bottom portion 32, then such friction panel 44 can be positioned at such location without departing from the spirit and scope of the present invention.

As was set forth above, such friction panel 44 tends to increase such frictional contact and therefore may be constructed from any appropriate frictional material, such as a felt, fabric, or a rubber or polymeric or elastomeric material, among other things. In various embodiments it has been empirically found that good results may be achieved by constructing the friction panel 44 from a rubber tread of a bicycle tire or the like. Such a friction panel 44 may be securely mounted to the internal surface of the front panel 20 by way of screws, glue, sonic or heat welding, or another appropriate mounting mechanism.

As was alluded to above, in any embodiment of the present invention, the panels 20, 22, 24 may be formed from any appropriate material without departing from the spirit and scope of the present invention. For example, the panels 20 may be constructed from wood, steel, or a plastic or elastomeric or polymeric material. Note here that a plastic or elastomeric or polymeric material may be considered to be advantageous, especially if the panels 20, 22, 24 are to be formed by a process such as injection molding, and/or if multiple ones of the panels 20, 22, 24 are to be formed joined together as a unitary body.

CONCLUSION

In the present invention, a supporting mount 18 is provided to attach a device 10 to a generally vertical columnar structure such as a vertical post 12, where the mount 18 is removably fixable to the post 12. The mount 12 is fixed to the post without the use of any screws or other fasteners that would be required to penetrate the post 12 or any covering on the post 12. Accordingly, the post 12 is not marred by the supporting mount 18, at least by the use of such fasteners, and the supporting mount 18 can be fixed to and removed from the post 12 with relative ease.

It should be appreciated that changes could be made to the embodiments described above without departing from the inventive concepts thereof. It should be understood, therefore, that this invention is not limited to the particular embodiments disclosed, but it is intended to cover modifications within the spirit and scope of the present invention as defined by the appended claims.

The invention claimed is:

1. A supporting mount for mounting a device to a generally vertical post having front and back faces and a pair of opposing side faces extending between the front and back faces, the mount for being removably fixed to the post without being fastened thereto by any fastener that would penetrate into the post, and comprising:

a front panel for being positioned at the front face of the post, the front panel having a pair of opposing lateral edges, the front panel for having the device fixed thereto;

a pair of opposing side panels for being positioned at respective side faces of the post, each side panel having a lower lateral edge that faces toward and connects to a respective lateral edge of the front panel and an upper lateral portion distal from the front panel, the lower lateral edge on each side panel for being vertically positioned with respect to the post to be relatively lower and the upper lateral portion on each side panel for being vertically positioned with respect to the post to be relatively higher, each side panel having a hook thereon at about the upper lateral portion thereof, the side panels being bilaterally arranged to mirror each other with respect to the post; and a connecting element separate from the post, the connecting element for being generally horizontally positioned at the back face of the post, the connecting element for interconnecting the side panels at about the upper lateral portions thereof by being retainingly engaged by the hooks thereat, the front panel, side panels, and connecting element for surrounding the post when the mount is fixed thereto, the device upon being fixed to the mount for causing same to pivot into a frictional contact with the back face of the post at the connecting element and with the front face at a portion of the front panel vertically lower than the connecting element, the frictional contact of the mount at the front and back faces of the post for resisting gravity and for preventing the mount with the device from sliding down the post even though the mount is not fastened to the post by any fastener that would penetrate into the post, the front panel including a friction-enhancing material securely mounted thereto at an internal surface thereof, the friction-enhancing material for causing the front panel to engage the post with an enhanced frictional contact.

2. The mount of claim 1 wherein each side panel is formed with the hook thereof as a unitary body and the hook is generally co-planar with the side panel, and wherein the connecting element is a dowel for being retainingly engaged by the hooks.

3. The mount of claim 2 wherein the dowel is for being retainingly engaged by the hooks by way of an interference fit.

4. The mount of claim 2 wherein the dowel is for being retainingly engaged by the hooks by way of engagement of the mount with the post holding the dowel in place with respect to the hook.

5. The mount of claim 2 wherein the dowel is for being moved generally horizontally into serial contact with each hook.

6. The mount of claim 2 wherein the dowel is for being moved into generally simultaneous contact with both hooks.

7. The mount of claim 1 wherein each side panel is formed to have a generally curving shape and also is formed with the hook thereof as a unitary body, the hook being part of the generally curving shape.

8. The mount of claim 1 wherein the friction-enhancing material comprises a rubber tread.

9. The mount of claim 1 wherein the front panel and side panels are integrally formed as a unitary body.

10. A supporting mount mounting a device to a generally vertical post having front and back faces and a pair of opposing side faces extending between the front and back faces, the mount being removably fixed to the post without being fastened thereto by any fastener that would penetrate into the post, and comprising:

a front panel positioned at the front face of the post, the front panel having a pair of opposing lateral edges, the front panel for having the device fixed thereto;

a pair of opposing side panels positioned at respective side faces of the post, each side panel having a lower lateral edge that faces toward and connects to a respective lateral edge of the front panel and an upper lateral portion distal from the front panel, the lower lateral edge on each side panel being vertically positioned with respect to the post to be relatively lower and the upper lateral portion on each side panel being vertically positioned with respect to the post to be relatively higher, each side panel having a hook thereon at about the upper lateral portion thereof, the side panels being bilaterally arranged to mirror each other with respect to the post; and a connecting element separate from the post, the connecting element being generally horizontally positioned at the back face of the post, the connecting element interconnecting the side panels at about the upper lateral portions thereof by being retainingly engaged by the hooks thereat, the front panel, side panels, and connecting element surrounding the post, the device as fixed to the mount causing same to pivot into a frictional contact with the back face of the post at the connecting element and with the front face at a portion of the front panel vertically lower than the connecting element, the frictional contact of the mount at the front and back faces of the post resisting gravity and preventing the mount with the device from sliding down the post even though the mount is not fastened to the post by any fastener that would penetrate into the post, the front panel including a friction-enhancing material securely mounted thereto at an internal surface thereof, the friction-enhancing material causing the front panel to engage the post with an enhanced frictional contact.

11. The mount of claim 10 wherein each side panel is formed with the hook thereof as a unitary body and the hook is generally co-planar with the side panel, and wherein the connecting element is a dowel retainingly engaged by the hooks.

12. The mount of claim 11 wherein the dowel is retainingly engaged by the hooks by way of an interference fit.

13. The mount of claim 11 wherein the dowel is retainingly engaged by the hooks by way of engagement of the mount with the post holding the dowel in place with respect to the hook.

14. The mount of claim 11 wherein the dowel is moved generally horizontally into serial contact with each hook.

15. The mount of claim 11 wherein the dowel is moved generally vertically into generally simultaneous contact with both hooks.

16. The mount of claim 10 wherein each side panel is formed to have a generally curving shape and also is formed with the hook thereof as a unitary body, the hook being part of the generally curving shape.

17. The mount of claim 10 wherein the friction-enhancing material comprises a rubber tread.

18. The mount of claim 10 wherein the front panel and side panels are integrally formed as a unitary body.

* * * * *